United States Patent [19]

Gehrke

[11] 4,175,700

[45] Nov. 27, 1979

[54] SUPPORT AND/OR LOCATING MEANS FOR RAILS IN RAIL TRACKS

[76] Inventor: Erich F. Gehrke, Krugersdorp, South Africa

[21] Appl. No.: 805,455

[22] Filed: Jun. 10, 1977

[30] Foreign Application Priority Data

Jun. 11, 1976 [ZA] South Africa ..... 76/3479
Aug. 26, 1976 [ZA] South Africa ..... 76/5129

[51] Int. Cl.[2] ..... E01B 9/40

[52] U.S. Cl. ..... 238/299; 238/287; 238/304; 238/306; 238/349

[58] Field of Search ..... 238/107, 264, 283, 287, 238/304, 306, 310, 349, 84, 299; 526/212

[56] References Cited

U.S. PATENT DOCUMENTS

| | | | |
|---|---|---|---|
| 388,240 | 8/1888 | Ashcroft | 238/306 X |
| 535,963 | 3/1895 | Stewart | 238/304 X |
| 2,386,315 | 10/1945 | Holstein | 238/349 X |
| 2,613,876 | 10/1952 | Boyce | 238/306 |
| 2,816,883 | 12/1957 | Larchar et al. | 526/212 X |
| 3,314,605 | 4/1967 | Waters | 238/349 X |
| 3,358,925 | 12/1967 | Pennino et al. | 238/287 |
| 3,494,557 | 2/1970 | Brown | 238/349 |
| 3,544,006 | 12/1970 | Pennino | 238/287 X |
| 3,827,631 | 8/1974 | Kirik | 238/287 X |
| 3,920,183 | 11/1975 | Houghton | 238/287 X |
| 4,061,270 | 12/1977 | Wandrisco | 238/107 |

FOREIGN PATENT DOCUMENTS

| | | | |
|---|---|---|---|
| 1014139 | 8/1957 | Fed. Rep. of Germany | 238/283 |
| 910744 | 11/1962 | United Kingdom | 238/349 |
| 1271186 | 4/1972 | United Kingdom | 238/349 |

*Primary Examiner*—Randolph A. Reese
*Attorney, Agent, or Firm*—Cushman, Darby & Cushman

[57] ABSTRACT

A rail pad made of substantially rigid electrically insulating material which is chosen to by yieldable to a predetermined extent, the pad having upstanding rail locating formations on its rail engaging face and oppositely directed pad locating formations on its sleeper engaging face to locate the pad relative to a supporting sleeper, the pad being provided with a series of recesses in its sleeper engaging face wherein the unrecessed area of the face is calculated to be capable of carrying the required load.

5 Claims, 12 Drawing Figures

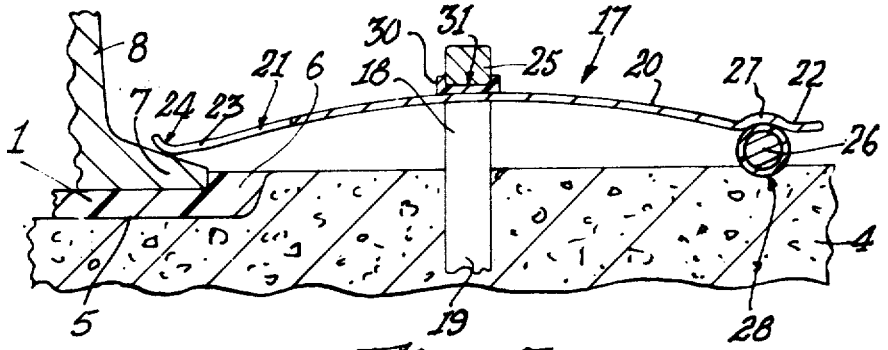
Fig 3.
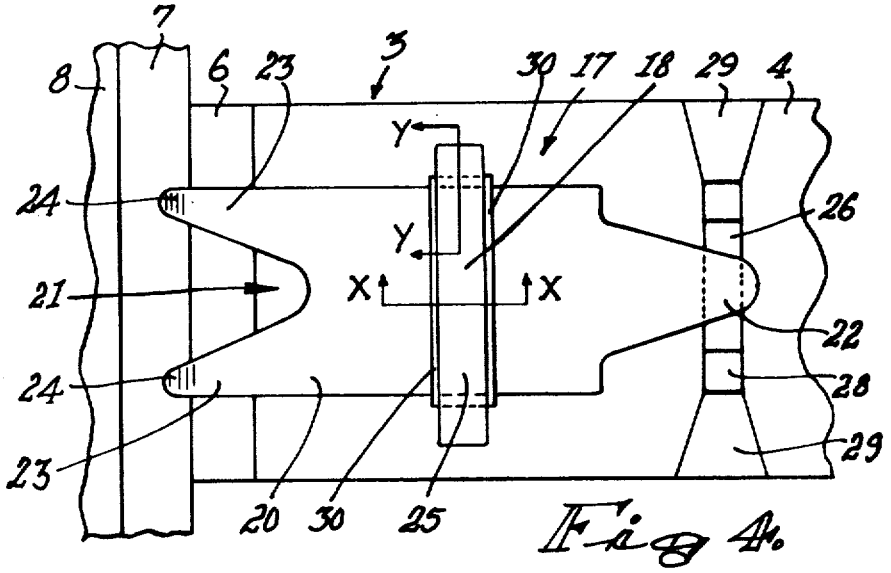
Fig 4.
Fig 5.
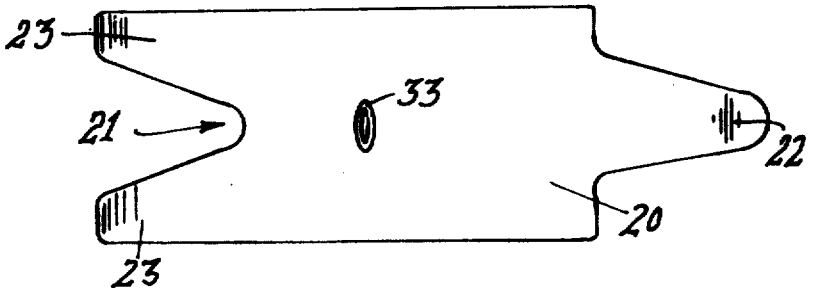

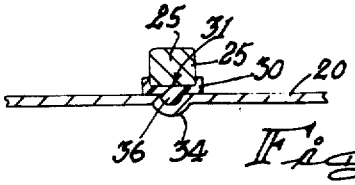
Fig 6.
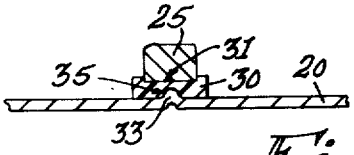
Fig 7.
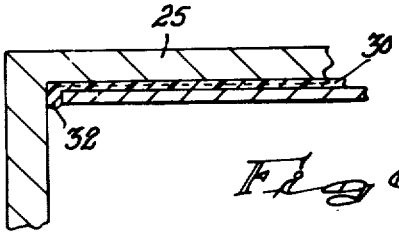
Fig 8.
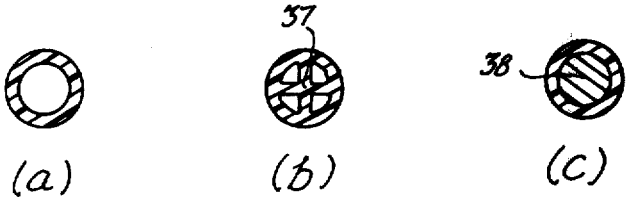
Fig 9.
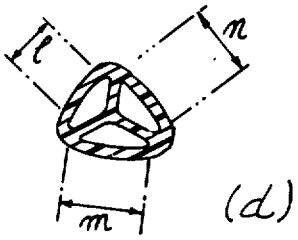

SUPPORT AND/OR LOCATING MEANS FOR RAILS IN RAIL TRACKS

This invention relates to support and/or locating means for rails of rail tracks and more particularly rail tracks which comprise rails ultimately supported on transverse sleepers in the usual way.

Still more particularly, but not exclusively, the invention is concerned with the provision of rail pads which are located between the rails and sleepers in order to support such rails on the sleepers. These rail pads are generally made of electrically insulating material which insulates the rails from the sleepers and thus from earth with the object of enabling them to be used to conduct electrical signaling currents. Plastics materials such as high density polyethylene have proved to be economical and effective for the manufacture of such rail pads.

Such plastics materials and also hard rubbers do, however, while having the required resistance to compression and the desired insulating properties, tend to crack or break if the surface of a sleeper on which a rail pad is supported is uneven. This is due to the fact that while being able to 'give' to a limited extent, such materials are substantially rigid. The provision of grooves and protrusions of conventional design have not been applied to such rail pads heretofore since they would, it is considered, increase the occurrence of cracks and breaking due to their providing weakened zones in the pads. For this reason such pads have been made of substantially constant thickness throughout. Such cracking or breaking can also be due to non-uniform stress resisting characteristics of the pads as a result of the techniques used in their manufacture.

It is the primary object of this invention to provide a rail pad made of the above types of substantially rigid materials which will have less tendency to crack or break than is the case with presently available similar rail pads.

A second object of the invention is to provide a rail pad requiring less material for its manufacture than in the case of presently available similar rail pads.

A third object of the invention is to provide a rail fastening device for optional use in conjunction with rail pads of this invention to complete the insulation of rails supported by such rail pads in use.

In accordance with this invention there is provided a rail pad made of a substantially rigid electrically insulating material which is chosen to be yieldable to a predetermined extent, the pad having upstanding rail locating formations on its rail engaging face and oppositely directed pad locating formations on its sleeper engaging face to locate the pad relative to a supporting sleeper, the pad being provided with a series of recesses in its sleeper engaging face wherein the un-recessed area of the said face is calculated to be capable of carrying the required load.

Further features of the invention provide for the recesses to be located inwardly of the periphery of the rail pad, for the unrecessed area of said face to define, inter alia, a series of elongated areas radiating from a central region of the face, and for the rail engaging face to be provided with recesses as well wherein such recesses are located to correspond with or fall within the plan projection of the recesses in the sleeper engaging face so that the full thickness of the pad is provided in the regions of at least part of the unrecessed areas of the faces of the rail pad.

Still further features of the invention provide for the rail pad to be made by an injection moulding operation and for the injection inlet to be located in a central region of one face of the rail pad.

The invention also provides a rail fastening assembly comprising a substantially U-shaped hoop adapted to be anchored to a railway sleeper, a leaf spring for insertion into the hoop and adapted to abut the cross member of the hoop and directly on a rail foot, and a spacing member for holding the spring in tension, the fastening assembly being characterized in that electrical insulating means are provided between the hoop and the leaf spring and in that at least the outer surfaces of the spacing member are electrically insulating.

Further features of this aspect of the invention provide for said insulating means to be either an insulating member adapted to be located between the hoop and the leaf spring or to be insulating members provided around the parts of the hoop which contact a sleeper in use.

Still further features of this aspect of the invention provide for the insulating member, in the case where it is located between the hoop and the spring, and the leaf spring to have complementary co-operating formations; for this insulating member to be in the form of a pad having a recess therein for partially receiving the cross member of the U-shaped hoop; and for the insulating pad to have lips on opposite ends thereof adapted to clip on to opposite longitudinal edges of the leaf spring.

Yet further features of this aspect of the invention provide for the spacing member to be cylindrical, for the member to be either tubular, or a tube provided with internal reinforcing ribs or even a steel core or a steel tube covered with insulating material and for the cylindrical member either to have a circular transverse cross-section or to have a triangular transverse cross-section with curved apices and wherein at least two of the sides of the triangle are of different length.

An embodiment of each of the aspects of the invention is now described by way of example only, reference being made to the accompanying drawings in which:

FIG. 3 is a sectional elevation of one side of a rail support and fastening system (i.e. that associated with one flange of a rail, the other being identical and oppositely directed);

FIG. 4 is a plan of one side of the system shown in FIG. 3;

FIG. 5 is a plan of a leaf spring;

FIGS. 6 and 7 are cross-sectional views on line X—X in FIG. 4 but of different arrangements;

FIG. 8 is a cross-sectional view on line Y—Y in FIG. 4; and

FIGS. 9 (*a*), (*b*), (*c*) and (*d*) are cross-sectional views of various different spacing members that could be used in the fastening system.

While the invention is not confined particularly to any specific materials of construction of the rail pad, the general properties of suitable materials are as follows, and such indicate broadly the meaning to be given to the term "substantially rigid" as used herein.

Suitable materials thus include:

(a) Hard Rubber having a Shore Hardness of from 60 to 80 on the A scale, (b) High density polyethylene having a Shore Hardness of from 62 to 68 on the D scale, (c) Polypropylene having a hardness of from 60 to 80 on the DIN 53456 scale of ball indentation hardness (30 second value).

Figure 1:
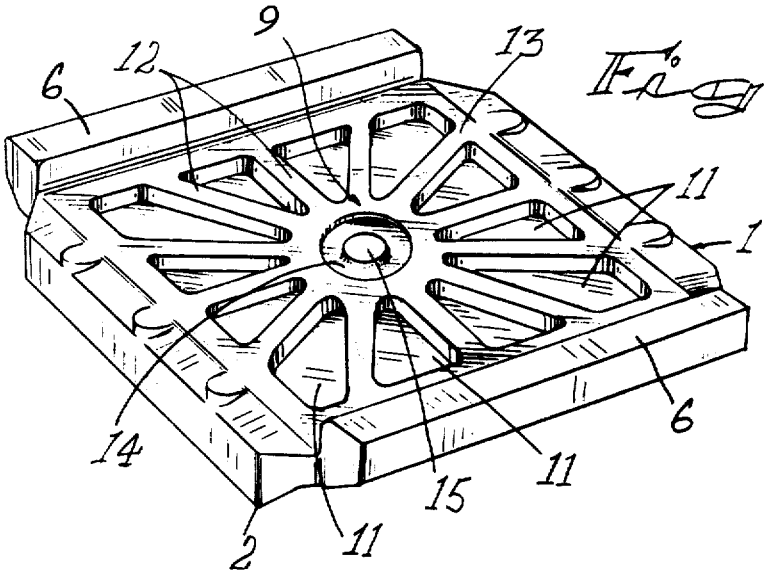
FIG. 1 is a perspective view of a rail pad in accordance with this invention.
Figure 2:
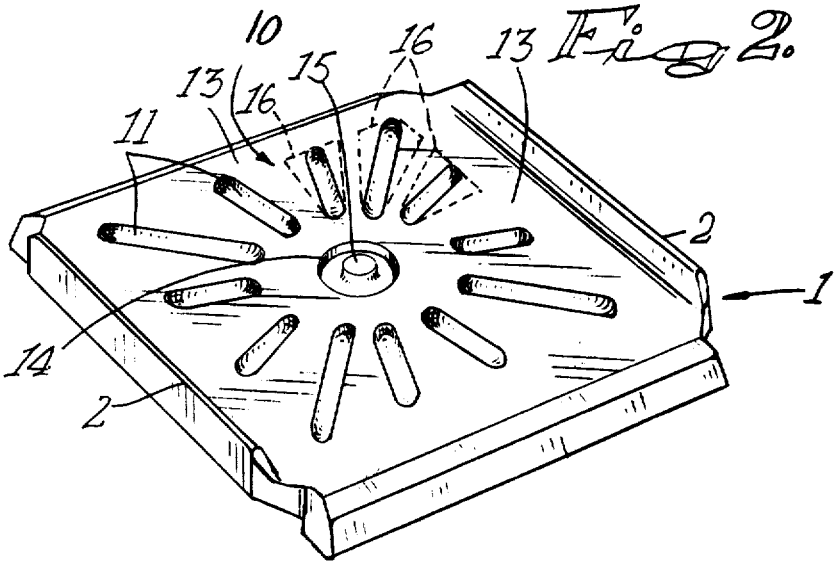
FIG. 2 is an inverted perspective view of the pad.

Referring now to FIGS. 1 and 2, a rail pad 1 is made of high density polyethylene, although other tough plastics materials or hard rubber could be used. Usually, the pad will have a substantially rectangular shape as illustrated. At two opposed ends of the pad, downwardly projecting flanges 2 are provided which engage the sides 3 of a railway sleeper 4 (see FIGS. 3 and 4) to locate the pad in use. The pad is, in use, preferably located in a recess 5 in the sleeper surface as shown clearly in FIG. 3. Along the sides of the pad, upwardly projecting flanges 6 are formed to locate the foot 7 of a track rail 8 in use. (FIGS. 3 and 4).

This pad is provided on the rail engaging and sleeper engaging faces 9 and 10 thereof with series of recesses 11. The recesses all extend roughly radially from a central region of each face. On the rail engaging face 9, the recesses occupy the majority of the area thereof and each recess diverges to define, between adjacent recesses, ridges 12 of roughly constant width while on the sleeper engaging face 10 the recesses are of substantially constant width with the interposed unrecessed areas diverging from the central region.

It should be noted that the recesses terminate short of the outer periphery of the rail pad thereby providing an outer peripheral zone 13 having the full thickness of the pad. Also, in the central region an annular recess 14 is provided which ensures that material may "flow" under stress into such recesses in the central region. The two annular recesses correspond in location and size with each other to leave a central nib 15 of material at the center which is again of the full thickness of the pad.

The roughly radially extending recesses on the sleeper engaging face are located, in plan view, within the area corresponding to the recessed area on the rail engaging face. This is indicated by the dotted lines 16 in FIG. 2. This leaves the full thickness of the pad between the recesses and corresponding in area to the ridges 12. It has been found that the above described construction operates extremely well in use. The material which has been used for these rail pads is high density polyethylene as above described as a material suitable for this purpose.

While the recesses are designed not to have a detrimental effect on the load resisting characteristics of the pad, they do improve seating of the pad and reduce cracking when the surfaces of the sleeper and rail are not uniform and have bumps or ridges thereon. Firstly, the recesses can accommodate certain surface irregularities and, furthermore, allow a certain deformation of the unrecessed areas to conform to the irregular surfaces. The latter is achieved also as a result of the recesses which provide space for the material displaced by the irregularities to be accommodated.

The pad is conveniently injection moulded from a point or points at the center 15 of the pad. This ensures an even and uniform distribution of the plastics to form the pad which is not the case when, for instance, the injection inlet is to one side. In turn, the causing of weakness at points or along planes in the pad is at least reduced.

The radial orientation of the recesses and unrecessed areas therebetween also facilitates the even distribution of material during injection but other types of arrangements, for instance a spiral configuration, could also be provided.

The rail pads may be used together with any suitable rail fastening assembly which insulates the rail from supporting sleepers therefor. However, one type of rail fastener will be described with reference to FIGS. 3 to 9.

As is usual, the rail is secured using a fastening assembly 17 to the concrete sleeper 4 and a rail pad 1 is interposed between the sleeper and rail.

The fastening assembly is of generally known type and comprises a substantially inverted U-shaped hoop 18 having the end portions 19 thereof embedded or otherwise anchored in the sleeper. The hoop is laterally spaced from the rail and has its plane parallel to the length of the rail. The hoop has a rectangular U-shape and is made of square section steel rod in this example. As will be appreciated by those skilled in the art, a similar assembly is provided on the opposite side of the rail.

A leaf spring 20 is included in the assembly and is constituted by a curved planar plate having a cut out 21 at one end and a tongue 22 of corresponding shape at its opposite end. The cut out forms two spaced projections 23 and, in use, the leaf spring is inserted through the hoop 18 so that the ends of the projections 23 abut the foot 7 of the rail 8. These ends are curved upwardly as shown at 24 in FIG. 3 and the spring is orientated with the highest part of its curve beneath the cross-member 25 of the hoop.

At the opposite end of the spring, that is, remote from the rail 8 a spacing member 26 is located beneath the tongue 22 in abutment with the sleeper so that the spring is held under tension against the rail foot, the cross-member of the hoop and the spacer itself. In this manner the rail is fastened by the assembly and the tongue 22 of the spring is preferably given a bend 27 to firmly locate the spacer relative thereto. Furthermore, the sleeper is recessed as indicated at 28 to locate the spacer relative to the sleeper, the ends 29 of this recess being outwardly tapered to allow dirt and the like to be easily cleared.

In the present case the projections directly abut the rail foot and the hoop has an electrically insulating member or members thereon which insulate the spring from earth. To this end, the limbs of the hoop could be provided with insulating sleeves or the like where they contact the sleeper (not shown) or, as illustrated, a pad 30 of electrically insulating material, for instance nylon, could be located between the leaf spring and the cross-member of the hoop.

In the drawings the pad is shown to extend along the width of the spring and has a longitudinal recess 31 therein which locates the pad relative to the cross-member. The ends of the pad are lipped as at 32 (see FIG. 8) so that the pad clips onto the spring to simplify assembly and also to ensure electrical insulation of the longitudinal edges of the spring from the limbs of the hoop.

To prevent slippage or relative movement between the pad and the spring in use, these two components are provided with complementary co-operating formations (see FIGS. 5 to 7). Thus the spring, on the side thereof facing the cross-member of the hoop, may have a projection 33 or indentation 34 therein and the pad has a complementary indentation 35 or projection 36 thereon respectively.

It is to be appreciated, however, that the insulating pad could be attached to the appropriate parts of the hoop or the spring by bonding. This bonding could be done either by adhesion or by moulding the pad onto the relevant component during manufacture.

To further provide the necessary electrical insulation of the spring from earth, it is necessary that the spacer 26 also have at least its outer surface covered with insulating material. For ease of installation, the spacer is cylindrical and has a generally rounded transverse cross-section. The spacer may be an insulating plastics tube (see FIG. 9 (*a*) ) or a plastics tube provided with internal reinforcing ribs 37 (see FIG. 9 (*b*) ) or a steel rod or tube 38 covered with plastics (see FIG. 9 (*c*) ).

It is to be appreciated that the height at which the tongue of the spring is held above the sleeper by the spacer will determine the force exerted on the rail. The higher the tongue, the greater the spring tension. With reference to FIG. 9 (*d*) a cylindrical spacer is shown which enables the length between the spring and the sleeper to be adjustably varied or which will ensure an approximately uniform fastening force in a series of assemblies where rails are placed on a continuous slab and adjustment of the rail height itself is necessary.

The spacer is of the type having internal reinforcing ribs and has a rounded triangular shape in cross-section. The sides of the triangle are all of different lengths l, m, n and it is readily apparent that by varying the orientation of the spacer in the recess therefor will have the effect described above. The same results could, of course, be achieved by having a series of spacers of different dimensions.

With further reference to the rail support and fastening system the rail foot rests on the electrically insulating rail pad which is itself located in a recess in the sleeper. Thus the rail is totally insulated from the sleeper.

What I claim as new and desire to secure by Letters Patent is:

1. A rail pad made of substantially rigid, electrically insulating material and having a rail engaging face and an opposite sleeper engaging face;

said rail pad having a hardness within one of the following ranges of hardness:

(a) 60-80 Shore A, (b) 62-68 Shore D, and (c) 60-80 DIN 53456 scale of ball indentation;

said pad having a pair of upstanding, spaced, parallel, rail locating formations on its rail engaging face to operatively receive therebetween a rail foot and having oppositely directed pad locating formations on its sleeper engaging face to operatively co-operate with a sleeper to locate the pad relative to the sleeper;

said pad being provided with a series of recesses in its sleeper engaging face and an unrecessed area outside said recesses;

the unrecessed area of said face being dimensioned to carry an operative load of a required magnitude and the said material being deformable under a predetermined stress to cause said material to flow into said recesses.

2. A rail pad as claimed in claim 1 in which the recesses are located inwardly of the periphery of the rail pad.

3. A rail pad as claimed in claim 1 in which the area of said face but for said recesses a series of elongated areas radiating from a central region of the face.

4. A rail pad as claimed in claim 1, in which:

the rail engaging face also is provided with a series of recesses therein and an unrecessed area outside these recesses, such recesses being located to correspond in plan projection with said recesses in the sleeper engaging face, the full thickness of the pad being provided in at least one portion of the respective unrecessed areas of the respective faces of the rail pad.

5. The rail pad as claimed in claim 1, being constituted by an injection moulding having a mould inlet artifact disposed substantially at the center of one said face of said rail pad.

* * * * *